US005103813A

United States Patent [19]

Hart et al.

[11] Patent Number: 5,103,813

[45] Date of Patent: Apr. 14, 1992

[54] NOSE CLIP FOR AQUATIC USAGE

[75] Inventors: Janice Hart, Oakdale; Edward M. deWeever, Smithtown, both of N.Y.

[73] Assignee: All American Hart, Inc., Oakdale, N.Y.

[21] Appl. No.: 293,088

[22] Filed: Jan. 3, 1989

[51] Int. Cl.[5] ..... A62B 18/02

[52] U.S. Cl. ..... 128/201.18; 128/200.24

[58] Field of Search ..... 128/201.18, 346, 200.24

[56] References Cited

U.S. PATENT DOCUMENTS

| | | | |
|---|---|---|---|
| 2,681,652 | 6/1954 | Laxton | 128/201.18 |
| 2,757,665 | 8/1956 | Tanikawa | 128/201.18 |
| 3,349,771 | 10/1967 | Baer | 128/201.18 |
| 4,033,342 | 7/1977 | Lake | 128/201.18 |
| 4,231,360 | 11/1980 | Zloczyski et al. | 128/201.18 |
| 4,445,508 | 5/1984 | Lake | 128/201.18 |

FOREIGN PATENT DOCUMENTS

| | | | |
|---|---|---|---|
| 190352 | 12/1922 | United Kingdom | 128/201.18 |
| 816887 | 7/1959 | United Kingdom | 128/201.18 |

*Primary Examiner*—Edgar S. Burr
*Assistant Examiner*—Aaron J. Lewis
*Attorney, Agent, or Firm*—Alfred M. Walker

[57] ABSTRACT

A nose clip for aquatic usage has an arc-shaped bridge portion having a front convex part and two rear edges, and two pear-shaped portions extending downwardly from the rear edges of the bridge portions and formed to be applied onto side surfaces of nostrils over a significant area and to press the latter inwardly so as to reliably close the nostrils channels.

4 Claims, 2 Drawing Sheets

NOSE CLIP FOR AQUATIC USAGE

BACKGROUND OF THE INVENTION

The present invention relates to a nose clip for aquatic usage.

Nose clips of the above mentioned general type are known in the art. They are used for clamping the nose shut to enable a person to swim under water. The nose clips are known in many modifications. U.S. Pat. Nos. 598,467; 640,629; 690,663; 2,064,986; 2,274,997; 2,924,217 disclose the nose clips which are attachable to a nose from beneath the nostrils. U.S. Pat. Nos. 2,488,616 and 4,238,360 show pad-like clips pressed against the nostrils. U.S. Pat. No. 2,681,652 discloses a nose clip which is applied underneath the nostrils and extends upwardly over the outer surface thereof. The clips which are applied from the lower edge of the nostrils distort the profile of the user's nose since they make the nose unnaturally longer in a downward direction. They are highly visible on the nose, and this is true actually for all known nose clips. The known clips usually have a complicated construction, a small area for compressing the nostrils, and a material which deteriorates under the action of water, chlorine and ultraviolet radiation.

SUMMARY OF THE INVENTION

Accordingly, it is an object of the present to provide a nose clip for aquatic usage, which avoids the disadvantages of the prior art.

More particularly it is an object of the present invention to provide a nose clip which has a simple construction, a minimum visibility of the face of a user, and at the same time a significant area of pressure application against the nose of a user so as to provide a reliable closing of nostrils channels during swimming, etc.

It is also an object of the present invention to provide a nose clip which has a substantially longer service life than the existing nose clips.

In keeping with these objects and with others which will become apparent hereinafter, one feature of the present invention resides, briefly stated, in a nose clip which has an arc-shaped bridge portion adapted to extend horizontally and having a front convex part and two rear edges, and two pear-shaped portions each extending from the rear edge of the bridge portion and flexibly biased toward one another, so that when the pear-shaped portions are applied onto the outer surfaces of the user's nostrils they occupy a significant area of the nostrils and press the nostrils toward one another to close the nostrils' inner channels. The upwardly located bridge portion which connects the pear-shaped portions with one another provides the above mentioned flexible spring-like urging of the pear-shaped portions toward one another.

Since the pear-shaped portions are connected by the bridge portion above them, located on the outer surfaces of the nostrils and urged toward one another, the whole clip has a simple, reliable and almost invisible construction. The last feature is further improved when the whole clip is composed of a transparent material.

Of course, the clip can be also colored by pigment when desired. On the other hand, it can be composed of a water-resistant, chlorine-resistant and ultraviolet resistant material, so that it does not deteriorate under the action of these factors and has a long service life.

The novel features of the present invention are set forth in particular in the appended claims. The invention itself, however, will be best understood from the following description of a preferred embodiment, which is accompanied by the following drawings.

DESCRIPTION OF A PREFERRED EMBODIMENT

Figure 1:
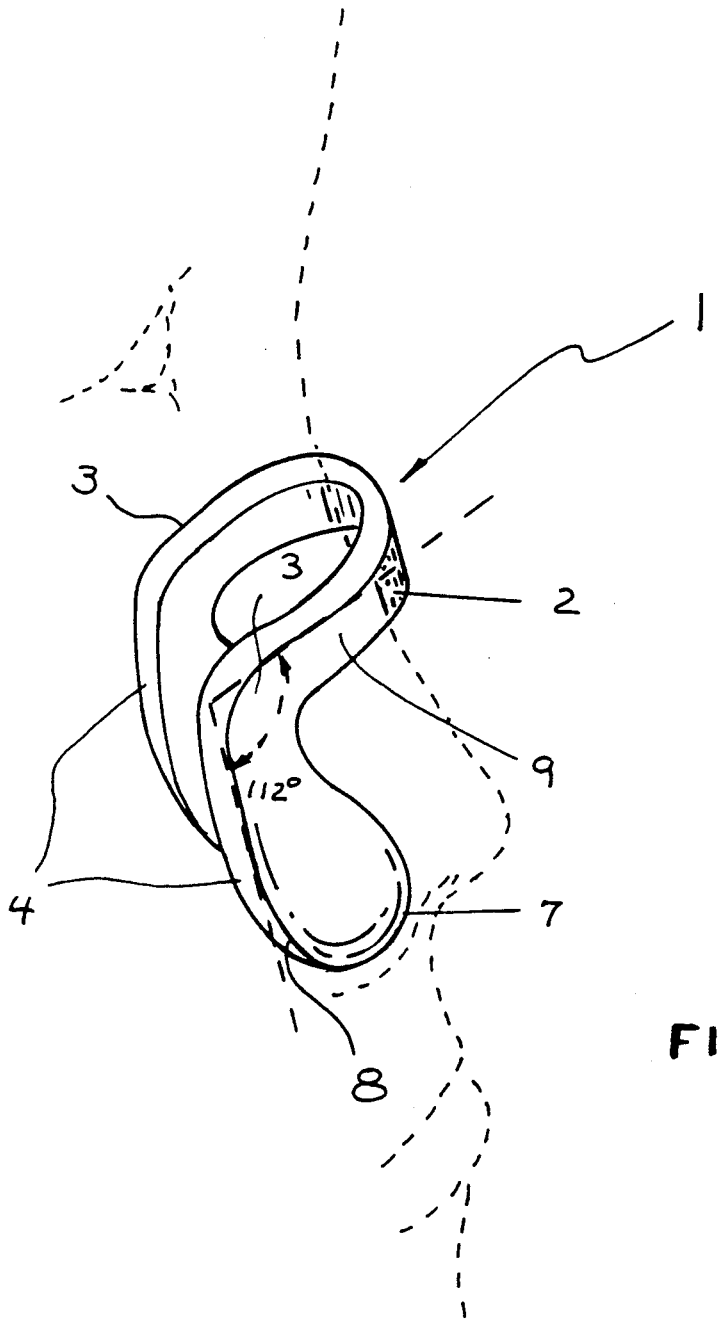
FIG. 1 is a perspective view which shows a nose clip in accordance with the present invention, on the nose of the user.
Figure 2:
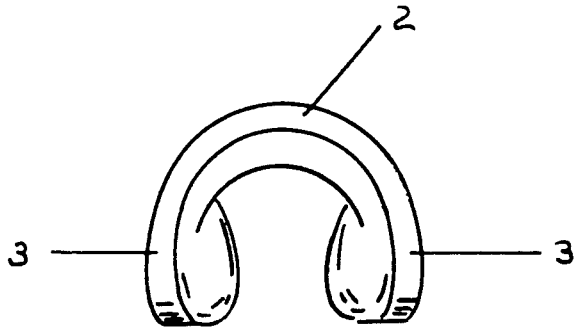
FIG. 2 is a plan view of the nose clip of the present invention.
Figure 3:
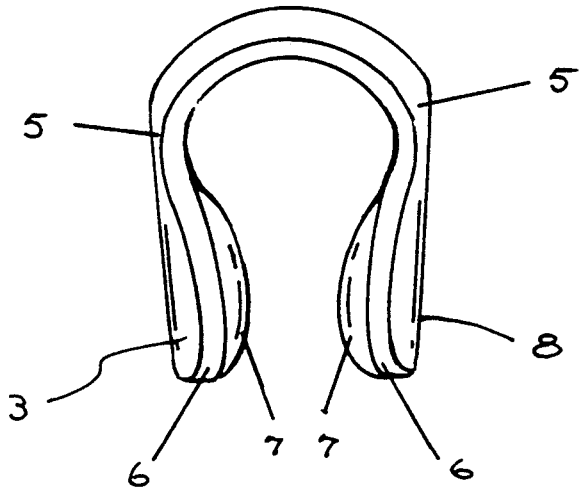
FIG. 3 is a front view of the nose clip of the present invention.

A nose clip in accordance with the present invention is a one-piece element which includes an arc-shaped bridge portion identified with reference numeral 1.

Figure 4:
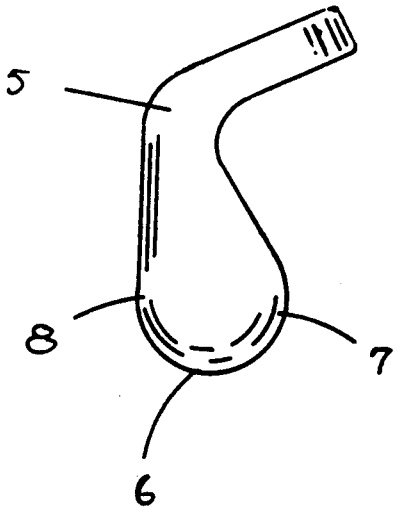
FIG. 4 is a side view of the inventive nose clip.

The bridge portion 1 has a forward convex part 2 and two rear edges 3. The nose clip further has two pear-shaped portions 4 each extending downwardly from a respective one of the rear edges 3. As can be seen from FIGS. 1 and 4, each pear-shaped portion has a width which increases downwardly from its upper end 5 to its lower end 6, and then has a rounding at the lower end. Therefore the area of each pear-shaped portion is maximized so that it occupies a significant area on the nostril and uniformly distributes its pressure over the latter.

The bridge portion 1 has a forward convex part 2 and two rear edges 3. The nose clip further has two pear-shaped portions 4 each extending downwardly from a respective one of the rear edges 3. As can be seen from FIGS. 1 and 4, each pear-shaped portion has a width which increases downwardly from its upper end 5 to its lower end 6, and then has a rounding at the lower end. Therefore the area of each pear-shaped portion is maximized so that it occupies a significant area on the nostril and uniformly distributes its pressure over the latter.

The bridge 1 is formed so that it flexibly urges the pear-shaped portions 4 toward one another in a springy manner so that when the clip is applied onto the nose, the pear-shaped portions compress the nostrils toward one another and close the channels in the nostrils.

The pear-shaped portions 4 are formed so that the distance between their front edges 7 is smaller than the distance between their rear edges 8. Therefore the pear-shaped portions follows the forwardly reducing width of the nose on a plan view or in a horizontal cross section. Moreover, the upper ends 5 of the pear-shaped portions 4 are spaced from one another by a distance which is greater than the distance between the lower ends 6 of the same. Therefore the pear-shaped portions 4 follow the decrease in the width of the nose in a downward direction from the nose bone.

An upper edge 9 of the bridge portion 1 extend at an obtuse angle to the rear edge 8 of the pear-shaped portion, so that when the nose clip is arranged on the nose, the rear edges 8 of the pear-shaped portions extend substantially along a line of transition between the nose and the cheeks of the face.

As can be seen from FIG. 1, when the nose clip in accordance with the present invention is on the nose, it is located exclusively on the side surfaces of the nose, does not project beyond the contours of the nose, and occupies a significant area of the latter to apply a sufficient and properly distributed pressure to the nostrils and to close the latter shut. The pear-shaped portions are located immediately under the nose bone and close this area of the nose so that air cannot accumulate in a significant quantity in the nose.

Since the pear-shaped portions are formed so that they are located immediately under the nose bone and not underneath the nostrils as in the prior art, the user does not have an urge to exhale as in the prior art. Therefore the firm retention of the nose clip of the invention on the nose is further increased.

The clip can be made of a transparent, clear material so that it is almost invisible on the user's nose. At the same time, this material is springy to urge the pear-shaped portions toward one another. The material can also be colored by a pigment if desired. Such materials may be made from conventional plastic forming methods, including injection molding, extrusion, blow molding, rotational molding or thermoformation.

In accordance with another very important feature of the present invention, the nose clip is composed of a water-resistant, chlorine-resistant and ultraviolet-resistant material. Therefore it does not deteriorate when used in and out of water, thus providing an increased service life. A suitable material for the nose clip of the invention can be for example Lexan,(®)produced by GE Plastics, a division of General Electric Company. Lexan(®)is a polycarbonate resin having the following qualities:

| | |
|---|---|
| Water absorption, percentage after submersion for 24 hours at 73° F. (23° C.) | 0.15% |
| Light transmittance, percentage at 0.125" at 400-700 mu | 89% |
| Flexural modulus, at $10^5$ psi | 3.40 |
| Deformation under load, percentage at 4,000 psi at 73° F. (23° C.) | 0.2 |

While the foregoing material qualities constitute those of the preferred embodiment, the following material characteristics are found to be acceptable:

| | |
|---|---|
| Optical refractive index | 1.40-1.60 |
| Light transmittance, percentage at 0.125" at 400-700 mu | 75-95% |
| Water absorption, percentage after submersion for 24 hours at 73° F. (23° C.) | 0.001-0.50% |
| Flexural strength (psi) | $6.0-23 \times 10^3$ |
| Tensile strength (psi) | $4.0-13 \times 10^3$ |
| Percent haze | less than or equal to 5% |

The materials properties are taken from *Plastics, Materials and Processes,* Seymour S. Schwartz and Sidney H. Goodman, 1982, 1st Edition. The purpose of these characteristics are to insure that the nose clip is water resistant, is generally transparent, and has a flexibility which enables the clip to bend without deformation while worn and removed by the user.

The invention is not limited to the details shown since various modifications and structural changes are possible without departing in any way from the spirit of the invention.

What is desired to be protected by Letters patent is set forth in the appended claims:

1. A nose clip for aquatic usage, comprising a substantially horizontal arc-shaped bridge portion which is convex forwardly and has two edges; and two pear-shaped portions each extending downwardly from a respective one of said rear edges of said bridge portion and flexibly biased toward one another so that when said pear-shaped portions are applied on outer surfaces of user's nostrils they occupy a significant area of the nostrils and press the nostrils toward one another so as to completely close inner channels of the nostrils;

each of said pear-shaped portions has an upper end and a lower end and has a width which increases from said upper end to said lower end;

each of said pear-shaped portions has a front edge and a rear edge, said front edges of said pear-shaped portions being spaced from one another by a distance which is smaller than a distance between said rear edges of said pear-shaped portions;

said upper ends of said pear-shaped portions being spaced from one another by a distance which is greater than a distance between said lower ends of said pear-shaped portions;

said bridge portion has an upper edge, said pear-shaped portions each having a rear edge, said rear edge of each of said pear-shaped portions forming an obtuse angle with said upper edge of said bridge portion;

said pear-shaped portions capable of occupying a significant area of a nostril of a user and capable of uniformly distributing closure pressure over the nostril to close the channels of the user's nostrils;

said bridge portion being located immediately under the nose bone of the user and said pear-shaped portions being capable of closing the area of the nose beneath the nose bone.

2. A nose clip as defined in claim 1, wherein said bridge portion and said pear-shaped portions are composed of a water-resistant, chlorine-resistant and ultraviolet-resistant material.

3. A nose clip as defined in claim 2, wherein the material is a polycarbonate resin having the following characteristics:

| | |
|---|---|
| Water absorption, percentage after submersion for 24 hours at 73° F. (23° C.) | 0.15% |
| Light transmittance, percentage at 0.125" | 89% |
| Flexural modulus, at $10^5$ psi | 3.40 |
| Deformation under load, percentage at 4,000 psi at 73° F. (23° C.) | 0.2 |

4. A nose clip as defined in claim 2, wherein the material is a plastic material having the following range of material characteristics:

| | |
|---|---|
| Optical refractive index | 1.40-1.60 |
| Light transmittance, percentage at 0.125" at 400-700 mu | 75-95% |
| Water absorption, percentage after submersion for 24 hours | 0.01-0.50% |
| Flexural strength (psi) | $6.0-23 \times 10^3$ |
| Tensile strength (psi) | $4.0-13 \times 10^3$ |
| Percent haze | less than or equal to 5% |

* * * * *